United States Patent [19]

Dizon et al.

[11] 4,405,844

[45] Sep. 20, 1983

[54] DOOR INTERLOCK FOR ELECTRICAL APPARATUS

[75] Inventors: Edmund S. Dizon, Chicago; Joseph P. Moninski, Jr., Northbrook, both of Ill.

[73] Assignee: S&C Electric Company, Chicago, Ill.

[21] Appl. No.: 364,354

[22] Filed: Apr. 1, 1982

[51] Int. Cl.[3] ..... H01H 9/20

[52] U.S. Cl. ..... 200/50 A

[58] Field of Search ..... 200/50 A, 50 AA; 361/335-345

[56] References Cited

U.S. PATENT DOCUMENTS

| | | | |
|---|---|---|---|
| 3,296,393 | 1/1967 | Rimmer et al. | 200/50 A |
| 3,385,938 | 5/1968 | Schockelt | 200/50 A |
| 3,991,291 | 11/1976 | McGuffie et al. | 200/50 A |

*Primary Examiner*—J. R. Scott

*Attorney, Agent, or Firm*—John D. Kaufmann

[57] ABSTRACT

A door interlock for electrical apparatus, which may include a switch, within an enclosure, permits the door of the enclosure to be opened only if the electrical apparatus is in a predetermined condition, such as switch-closed. Once the switch has been opened, the door may be opened. The interlock prevents the switch from being reclosed as long as the door is open. A latch holds the door closed if the switch is closed, if the door is locked closed by a door lock, or if both conditions obtain. If the switch is opened while the door is locked closed by the door lock, the latch continues to latch the door closed. If the door lock is unlocked while the switch remains closed, the door latch likewise latches the door closed.

14 Claims, 8 Drawing Figures

20
22
24
65
66
67
68
69
70
75
76
77
78
79
80
81
81a
81b
90
92
94
96
98
100
102
104
108
110
113
114
116
118
120
122
125
126
128
130
132
134
136
138
140
142
144
38
45
46
48
50
52
56
57
58
62
64

DOOR INTERLOCK FOR ELECTRICAL APPARATUS

BACKGROUND OF THE INVENTION

1. Field of the Invention

The present invention relates to a door interlock for electrical apparatus. More specifically, the present invention relates to an improved door interlock for electrical gear, which includes electrical apparatus within an enclosure, which interlock permits a door of the enclosure to be opened only if the electrical apparatus therewithin is in a certain condition and which prevents the condition of the apparatus from changing once the door is opened.

2. Brief Description of the Prior Art

Numerous door interlocks for electrical apparatus contained within an enclosure are known. See, for example, commonly assigned U.S. Pat. Nos. 4,073,000; 3,790,861; 3,748,621; and 3,339,118; and the following U.S. Pat. Nos. 4,118,607; 4,034,169, 3,991,291, 3,882,291; and 3,778,567. The typical environment of use for these prior art interlocks is within or as a part of the enclosure for the electrical apparatus which may include switches, movable between opened and closed positions. The interlocks may be associated with the switches in order to prevent the opening of a door for the enclosure as long as the switches are closed. With the switches closed and the electrical apparatus within the enclosure connected to an electrical circuit, electrical components within the enclosure are energized. With the switches opened, components, such as fuses, connected to the load side thereof are de-energized and may be handled or manipulated by workers. Prior art interlocks have, accordingly, often functioned to prevent the door from being opened until the switches within the enclosure are opened. Once these switches are opened and the door has been opened, the de-energized components in the enclosure may be handled or manipulated. Prior art interlocks also often prevent reclosing of the switches as long as the door is opened. This prevents the formerly de-energized components from becoming re-energized.

Many prior art interlocks, as functionally described above, suffer from one or more of three shortcomings. First, some interlocks are extremely complicated and, accordingly, are expensive and time-consuming to fabricate, manufacture and assemble. Second, the alignment, location or size of the parts of the interlocks must often be precisely controlled in order to ensure proper operation thereof. This is often quite difficult where the interlocks are complicated and contain numerous parts. Third, in many prior art interlocks, high forces are applied to non-robust parts which can cause both the failure thereof and the ultimate inability of the interlock to perform its intended functions.

A primary object of the present invention is the provision of an uncomplicated and inexpensive interlock which is convenient to fabricate, manufacture and assemble and which has a minimum of parts. A further object of the present invention is the provision of an interlock in which the need to precisely control the alignment, location and size of parts thereof is minimized, and the parts of which are not subjected to failure-producing high forces.

SUMMARY OF THE INVENTION

With the above and other objects in view, the present invention in its broadest aspects contemplates an improved interlock for electrical apparatus which is located in a walled enclosure. Typically, the apparatus may consist of or include electrical switches. The interlock prevents opening a door of the enclosure if the apparatus is in a first condition—typically, when the switches thereof are closed—and permits opening the door to provide access to the apparatus only if the apparatus is in a second condition—typically, when the switches are opened. Further, the interlock prevents the apparatus from assuming the first condition—that is, prevents the switches from closing—when the door is opened.

The interlock includes a latching facility on the enclosure. The latching facility is typically on an interior surface of the enclosure and is mounted for movement between a first position and a second position. When the latching facility assumes its first position, the closed door is latched against opening. When the latching facility assumes its second position, the door is unlatched for opening. A cam follower is mounted on the enclosure, typically, on a interior surface thereof, for movement between a first position and a second position. In its first position, the cam follower holds the latching facility in its first position. In its second position, the cam follower holds the latching facility in its second position. The cam follower is biased toward its second position.

A locking facility is located on the door, typically on a rear surface thereof, and is operable from the exterior of the enclosure for movement between a first position and a second position. In its first position, the locking facility locks the closed door against opening and holds the cam follower in its first position. In the second position of the locking facility, the closed door is unlocked for opening and the cam follower is freed for movement to its second position under the biasing action. The closed door is openable only if the locking facility and the latching facility are both in their second positions.

A movable control facility associated with the electrical apparatus is movable between a first and a second position, depending upon the condition of the electrical apparatus. The control facility is unable to move out of its first position if the apparatus is not in its second condition, that is, if the switches are not open. The control facility is movable to its second position only if the apparatus is in its second condition, that is, only if the switches are open.

A facility prevents the apparatus from assuming its first condition—that is, prevents the opened switches from closing—if the control facility is in its second position.

A facility interconnects the control facility and the cam follower and performs three functions. First, the interconnecting facility holds the control facility in its first position when the cam follower is held in its first position. Second, the interconnecting facility moves the control facility to its second position if the cam follower has moved to its second position and the apparatus is in its second condition, that is, the switches are opened. Third, the interconnecting facility prevents the cam follower from moving to its second position if the control facility is unable to move to its second position.

Thus, the door is locked and latched in its closed position if the switches are closed and the locking facility is in its first position. If the locking facility is moved to its second position, but the switches remain closed, the door remains latched closed due to the inability of the control facility to move to its second position. Once the door is opened, following opening of the switches and movement of the locking facility to its second position, they may not be reclosed until the door is closed and the locking facility reassumes its first position.

DETAILED DESCRIPTION

Figure 1:
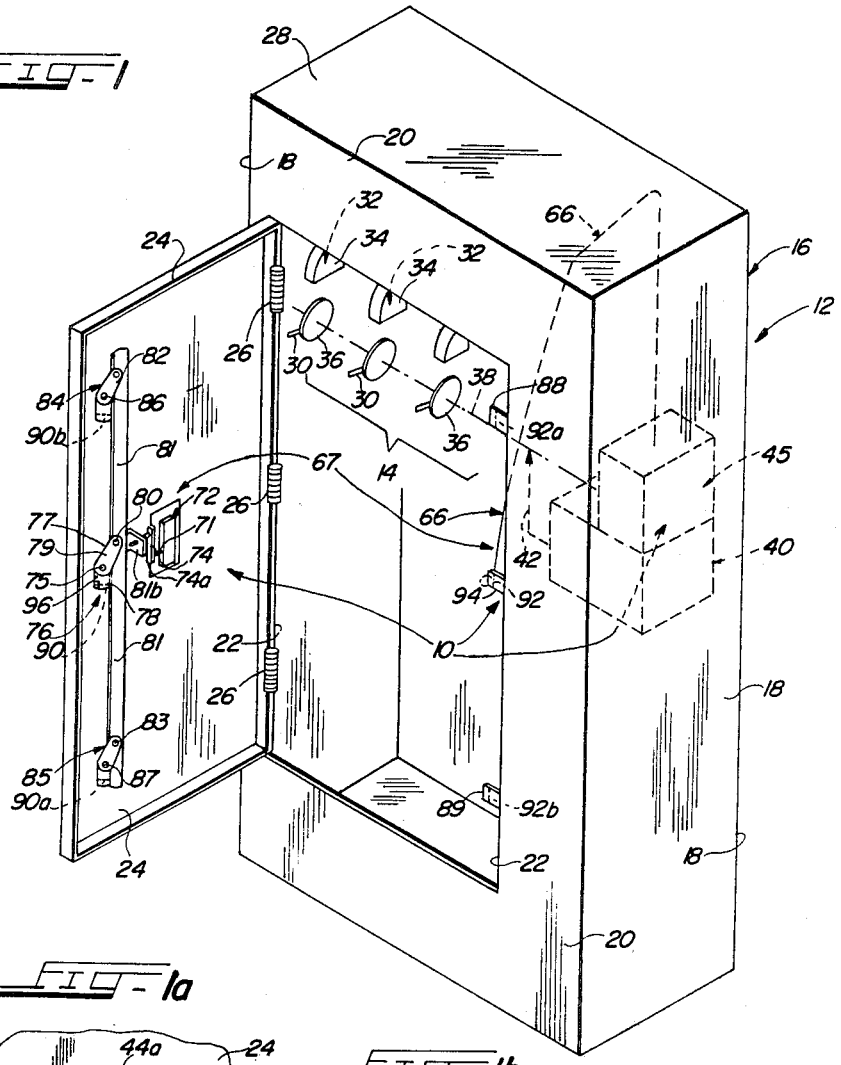
FIG. 1 is a perspective view of an interlock according to the present invention used with electrical apparatus within an enclosure which has a door.

Referring first to FIG. 1, an interlock 10 according to the present invention may be used with high-voltage electrical gear, generally indicated at 12. The electrical gear 12 may include a plurality of switches, generally indicated at 14, housed within an enclosure 16. The electrical gear 12 may include appropriate bus work (not shown) for connection of the switches 14 to a three-phase high-voltage electrical circuit (not shown) and may additionally include a plurality of high-voltage fuses (not shown) in series with the switches 14.

The enclosure 16, which may be made of heavy gauge steel, includes three vertical walls 18 and a front wall 20 having an opening 22 therethrough. The opening 22 is normally closed by a metal door 124 pivotally mounted to the front wall 20 at one edge of the opening 22 by a plurality of hinges 26. A metal roof 28 overlies and is connected to the walls 18 and 20. When the door 24 is opened, as shown in FIG. 1, access to the interior of the enclosure 16 is provided for purposes of replacing the fuses (not shown) or of inspecting, maintaining or repairing the switches 14 or any other electrical components within the enclosure 16.

The switches 14 may be of the load-break type illustrated in commonly assigned U.S. Pat. Nos. 3,980,977; 3,576,967; and 3,549,840. Each switch 14 includes a member such as a movable switchblade 30 which may be selectively moved into (switch closed) or out of (switch open) engagement with respective stationary contacts, generally indicated at 32. The stationary contacts 32 may be constructed along the lines disclosed in commonly assigned U.S. Pat. Nos. 4,169,973 or 3,676,629. The stationary contacts 32 are contained within arc compressors or arc chutes 34. The switchblades 30 are respectively connected to one side of one phase of the three-phase electrical circuit by sliding contact structure (not shown) associated with a mount 36 for each switchblade 30. The stationary contacts 32 are respectively connected to the other side of the electrical circut. The mounts 36 and the stationary contacts 32 may be connected to the electrical circuit by the bus work or by cables (not shown) within the enclosure 16.

The mount 36 for each switchblade 30 is carried by a rotatable insulative shaft or strut 38 (see FIGS. 1 and 3*a*–3*d*). Rotation of the shaft or strut 38 moves the switchblades 30 in common into or out of engagement with their respective stationary contacts 32 to close or open the switches 14. The shaft or strut 38 may be rotated by an operator, such as a stored-energy operating mechanism generally indicated at 40, which may be as disclosed in one or more of the following commonly assigned U.S. Pat. Nos.: 4,308,441; 4,253,003; 4,238,657; 4,237,357; 4,223,483; 4,206,329; 4,190,755, 3,980,977; 3,898,420; 3,563,102; and 2,954,450. The operating mechanism 40, which is preferably contained within the enclosure 16, may be manual and require the manipulation of an operating handle (not shown) accessible from the exterior of the enclosure 16. The operating mechanism 40 may also be automatic and may rotate the shaft or strut 38 in response to conditions of the circuit to which the switches 14 are connected as detected by sensors (not shown) connected between the circuit and the operating mechanism 40. In either event, there is a drive shaft or other operative connection, generally indicated at 42, between the operating mechanism 40 and the shaft or strut 38 for opening and closing the switches 14.

Figure 1A:
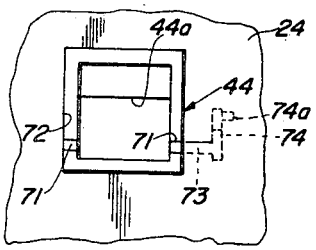
FIGS. 1*a* and 1*b* are enlarged elevations of portions of the door of FIG. 1 showing a handle and other elements operated thereby.

Because the electrical gear 12 is connected to a high-voltage electrical circuit, consideration must be given to the safety of workers who replace the fuses (not shown) or who otherwise inspect, repair or maintain the gear 12, including the switches 14. To this end, appropriate connection of the gear 12 between an electrical source and electrical loads may be made so that certain of the electrical components within the enclosure 16, which are likely to be contacted by workers when the door 24 is opened, are de-energized when the switches 14 are opened. Therefore, according to the present invention, the interlock 10 functions as follows. First, the door 24 may be opened by appropriate manipulation of a handle 44 (FIG. 1*a*) on the exterior of the door 24 only if the switches 14 are opened, that is, their switchblades 30 are disengaged from their stationary contacts 32. Second, the interlock 10 prevents the open switches 14 from being closed as long as the door 24 is opened. Assuming the stationary contacts 32 to be connected to a power source (not shown) and the switchblades 30 to be connected to loads (not shown), both functions of the interlock 10 both require the switchblades 30 and any components directly connected thereto to be de-energized before the door 24 can be opened and maintain the switchblades 30 and such components de-energized as long as the door 24 is opened. As described below, to open the door 24, appropriate manipulation of the handle 44 and opening of the switches 14 may occur in either order, as long as both events occur. Only if both events occur can the door 24 be opened.

Referring now to FIGS. 1 and 3*a*–3*d*, there is depicted a switch control portion 45 of the interlock 10. An end member 46 forms a portion of a metal frame assembly, only generally indicated at 48 in FIGS. 3*a*–3*d*, which surrounds and mounts the switches 14 within the enclosure 16. The end member 46 rotatably mounts one end of the shaft or strut 38 which may protrude therethrough. If the end of the shaft strut 38 is prevented from rotating, movement of the switchblades 30 by the operating mechanism 40 is prevented.

As shown in FIGS. 3*a*–3*d*, mounted to the protruding end of the shaft or strut 38 for rotation therewith is a cam 50. The cam 50 includes a circular peripheral surface 52, which contains a notch 56. Pivotally mounted to the end member 46 by a pin 57 is a locking arm 58. The locking arm 58 carries a locking stud 62 which may be received by the notch 56 if the cam 50 is appropriately positioned. Also attached to the locking arm 58 remotely from the pin 57 and the locking stud 62 is a cable connector 64 which attaches a first end of a movable inner portion 65 of a control cable 66 to the locking arm 58. As shown in FIG. 1, and generally in FIGS. 3a–3d, the control cable 66 may be trained in any convenient manner within the enclosure 16 between the switch control portion 45 of the interlock 10 and a door control portion 67 of the interlock 10.

Figure 3A:
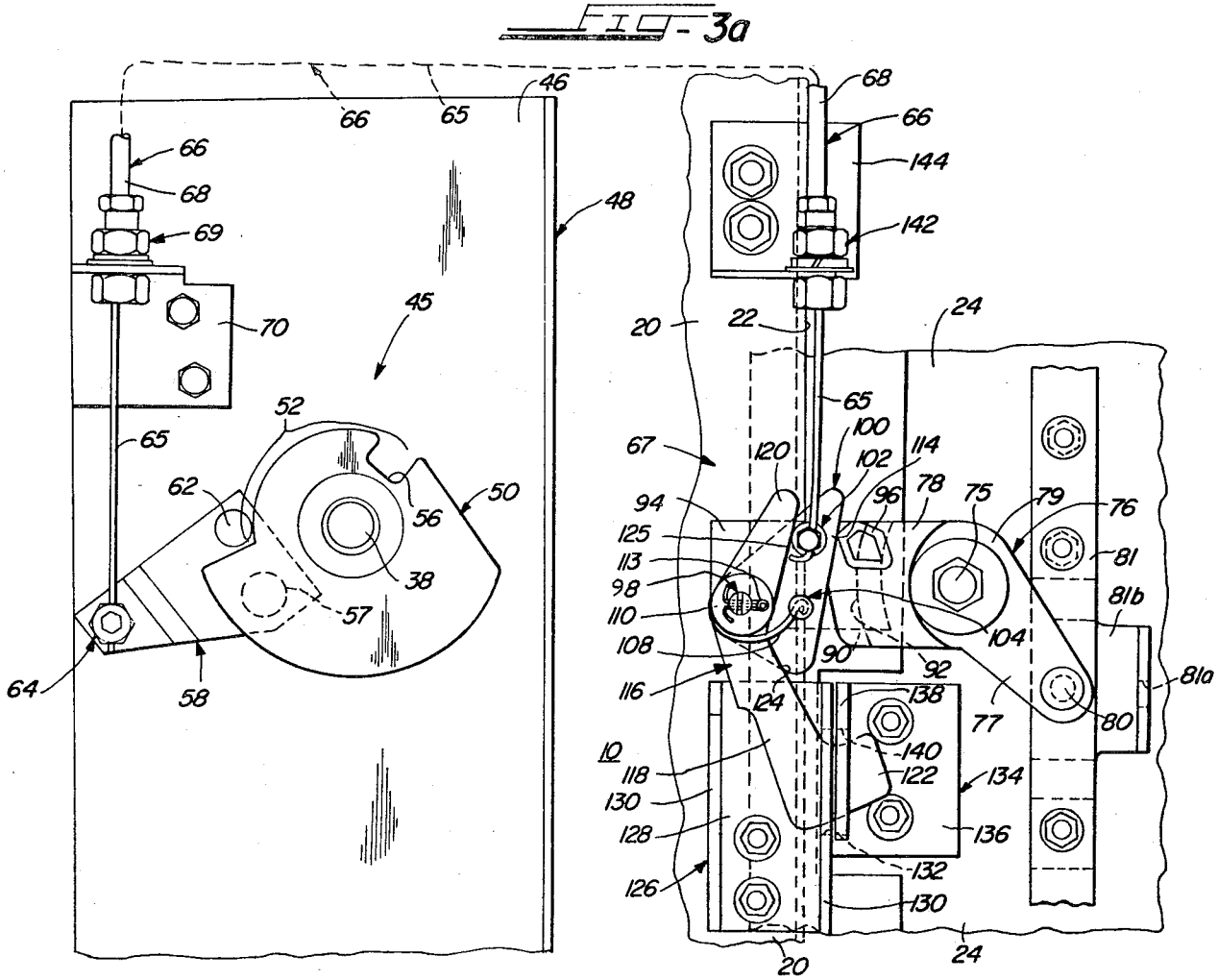
FIGS. 3*a*–3*d* are rear elevations of the door control portion of the interlock shown in FIG. 2 and a front elevation of a switch control portion of the interlock at different times during the operation thereof.
Figure 3B:
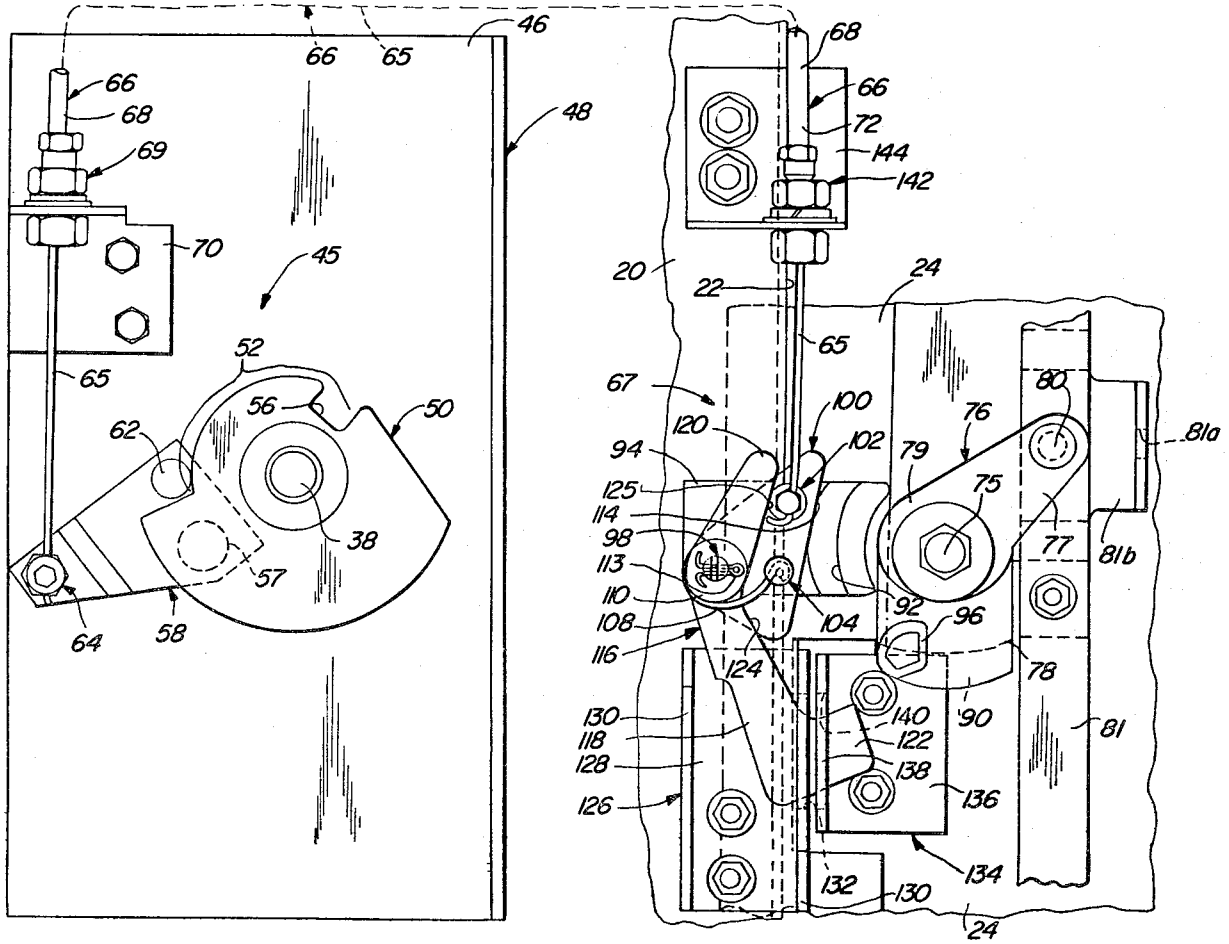
Figure 3C:
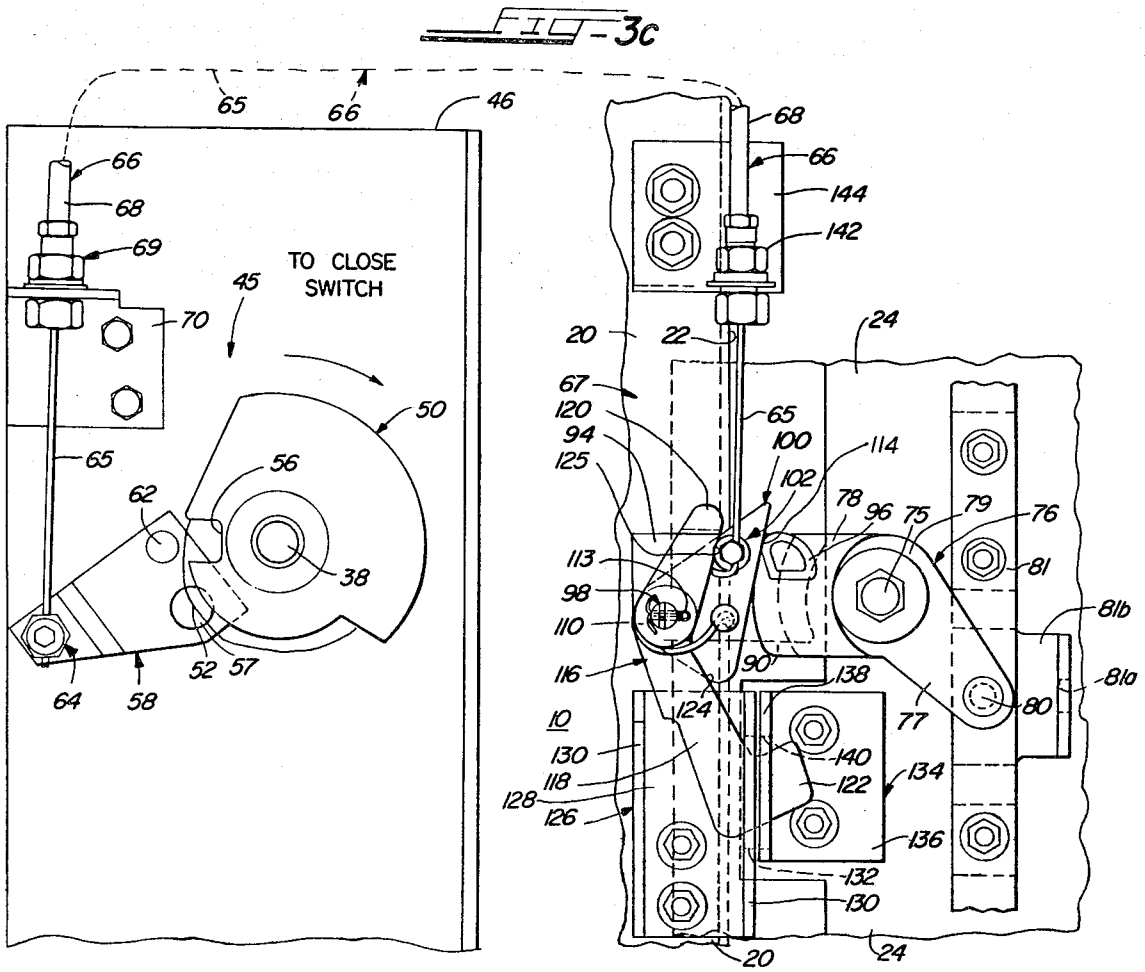

In the positions of the shaft or strut 38 and the locking arm 58 depicted in FIGS. 3a and 3b, the switches 14 are closed and the locking arm 58 cannot pivot clockwise, because the locking stud 62 is positioned adjacent to and abuts (but may ride over) the surface 52 of the cam 50. If the shaft or strut 38 and the cam 50 rotate counterclockwise to the positions depicted in FIGS. 3c and 3d, the switches 14 are opened and the notch 56 moves to a position whereat it is enterable by the locking stud 62 (FIG. 3c). If the locking stud 62 thereafter enters and remains in the notch 56 (FIG. 3d) due to clockwise rotation of the locking arm 58, the cam 50 is unable to subsequently rotate clockwise. The inability of the cam 50 to rotate clockwise renders the shaft or strut 38 unable to rotate and, accordingly, holds the switches 14 opened until the locking arm 58 rotates counterclockwise to remove the locking stud 62 from the notch 56. In alternative embodiments, the cam 50 and the locking arm 58 or equivalent structure may be associated with the output shaft 42 of the operator 40. In this event, entry of the locking stud 62 into the notch 56 prevents the operator 40 from closing the switches 14. In further alternative embodiments, it may be desirable for the locking stud 62 to be able to enter the notch 56 and hold the cam 50 against rotation only when the switches 14 are closed. This may be achieved by various obvious expedients.

A first end of a stationary outer portion 68 of the control cable 66 (FIGS. 3a–3d) may be held by a cable housing assembly 69 attached to a bracket 70. The bracket 70 is mounted, as convenient, to the end member 46 of the frame assembly 48.

Figure 3D:
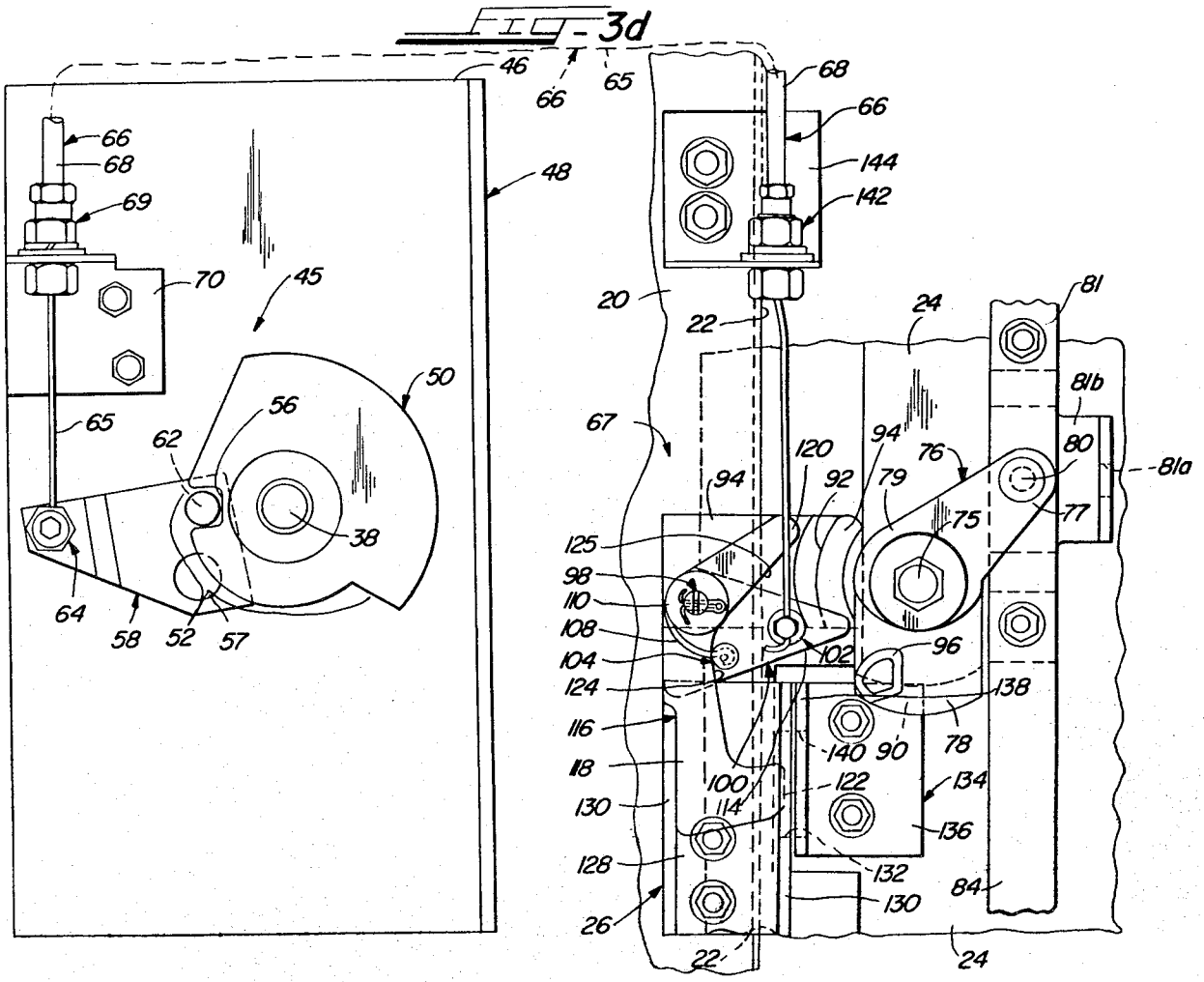

With the cam 50 positioned as in FIG. 3c, upward movement of the first end of the inner portion 65 of the control cable 66 pivots the locking arm 58 clockwise about the pin 57 to insert the locking stud 62 into the notch 66 (FIG. 3d). Downward movement of the first end of the inner portion 65 of the control cable 66 removes the locking stud 62 from the notch 56 (FIG. 3c) by pivoting the locking arm 58 counterclockwise. With the cam 50 positioned as in FIGS. 3a and 3b, the locking arm 58 cannot pivot clockwise on the pin 57 due to interference between the locking stud 62 and the surface 52 of the cam 50, and, accordingly, the first end of the inner portion 65 of the control cable 66 cannot move.

Turning now to FIGS. 1a, 2 and 3a–3d, there is depicted in detail the door control portion 67 of the interlock 10 according to the present invention. As generally shown in FIG. 1, the door control portion 67 is preferably located on the rear surfaces of the front wall 20 and the door 24 substantially midway between the top and the bottom of the opening 22.

Figure 1B:
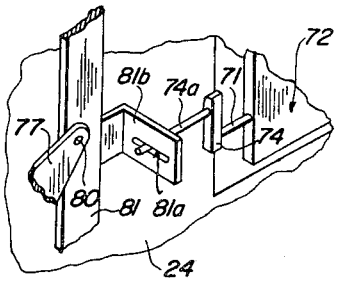
Figure 2:
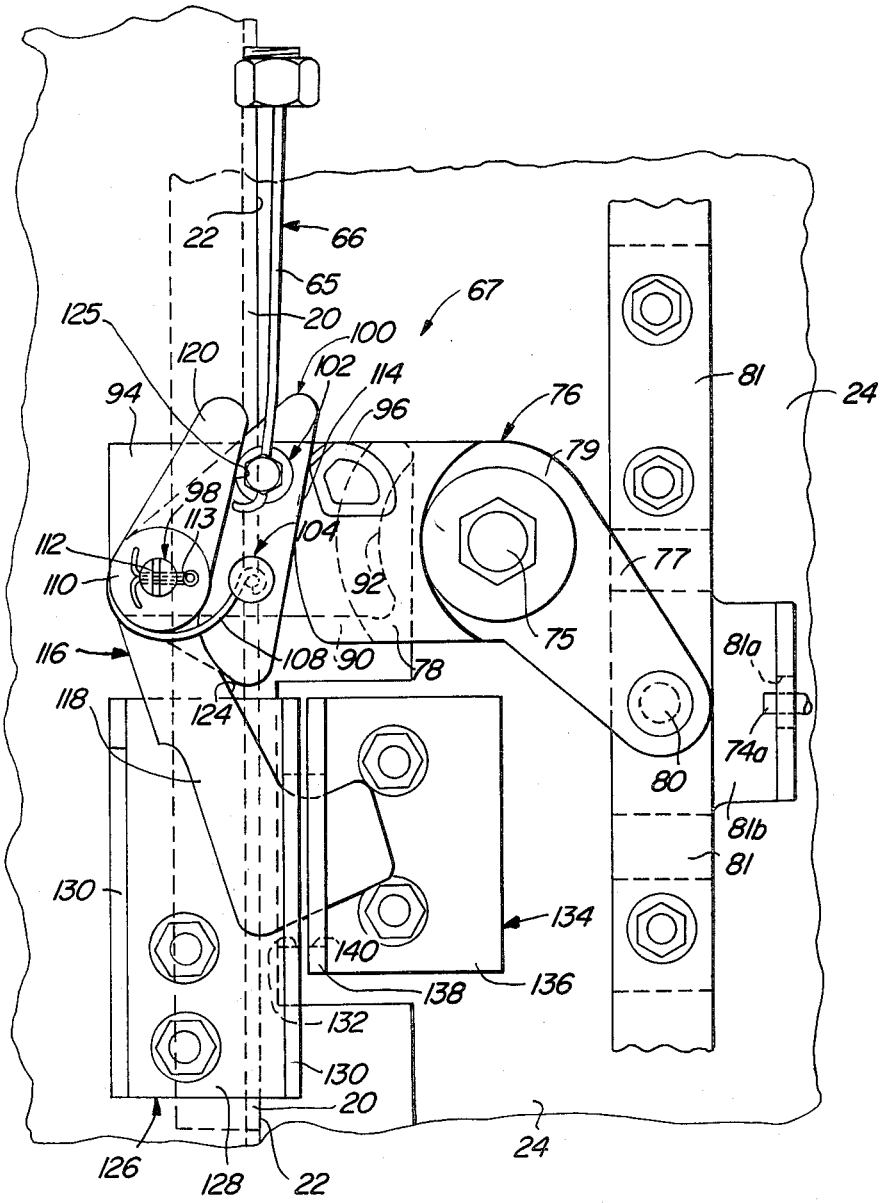
FIG. 2 is a rear elevation of a door control portion of the interlock shown in FIG. 1 depicting from the interior of the enclosure the manner in which the door control portion of the interlock is operated by manipulation of the handle of FIG. 1*a*.

The handle 44, which is accessible from the exterior of the enclosure 16 when the door 24 is closed, may take any convenient form. In the specific embodiment shown in FIGS. 1a and 1b, the handle 44 is mounted on a shaft 71 within a pocket 72 formed in the front surface of the door 24. The shaft 71 passes through and is rotatably held by the side walls of the pocket 72. One end 73 of the shaft 71 protrudes well beyond the pocket 72 adjacent to the rear surface of the door 24. The end 73 of the shaft 71 carries a crank 74.

Referring to FIGS. 1, 2, and 3a–3d, mounted to the rear surface of the door 24 by a stub shaft 75 for rotation by the handle 44 is a locking lever assembly 76. The locking lever assembly 76 includes two projections 77 and 78 integral with a main body 79 which is positioned on the stub shaft 75. The projection 77 is pivotally connected by a pin 80 to the midpoint of a latch rod 81 which is vertically reciprocable parallel to the rear surface of the door 24. At its upper and lower ends (see FIG. 1) the latch rod 81 is pivotally attached by pins 82 and 83 to locking levers 84 and 85 pivotally mounted to the rear surface of the door 24 by stub shafts 86 and 87. The locking levers 84 and 85 are engageable with locking brackets 88 and 89 mounted to the rear surface of the front wall 20 at the top and the bottom of the opening 22, as described below. With the locking lever assembly 76 and the latch rod 81 positioned as shown in FIGS. 3a and 3c, and with the door 24 closing the opening 22, the locking levers 84 and 85 engage the locking brackets 88 and 89, locking the top and the bottom of the door 24 in the closed position. As viewed in FIGS. 1, 3b, and 3d, reciprocation of the latch rod 81 upwardly rotates the locking levers 84 and 85 counterclockwise out of engagement with the locking brackets 88 and 89 to unlock the top and bottom of the door 24. Such upward reciprocation of the latch rod 81 also rotates the locking lever assembly 76 counterclockwise for a purpose described below.

The latch rod 81 is reciprocated by rotation of the handle 44 on the shaft 71 in the pocket 72. Specifically, when the handle 44 is rotated, the shaft 71 rotates to rotate the crank 74, FIGS. 1a and 1b. A pin 74a carried by the crank 74 is positioned in a slot 81a (FIGS. 1b and 2) formed in a projection 81b of the lach rod 81. Rotation of the crank 74 and its pin 74a reciprocates the latch rod 81. To facilitate rotation of the handle 44 when it is within the pocket 72 (when the locking lever assembly 76 and the latch rod 81 are positioned as in FIGS. 2, 3a, and 3c), the handle 44 may include a finger-engageable lip 44a (see FIG. 1a). Reciprocation of the latch rod 81 moves the pin 80 to rotate the projection 77 and the locking lever assembly 76 on the stub shaft 75.

As viewed in FIGS. 3a–3d, the projection 78 carries on its underside a curvilinear projection 90. The curvilinear projection 90 is shaped so as to be slidably receivable within a curvilinear depression 92 (see FIGS. 3b and 3d) formed near the free end of a locking bracket 94. The locking bracket 94 is attached, as by welding or the like, to the inside surface of the front wall 20 at a position where, with the door 24 closed, the curvilinear projection 90 may enter or move out of the curvilinear depression 92 upon rotation of the locking lever assembly 76 due to manipulation of the handle 44. With the locking lever assembly 76 in the position shown in FIGS. 2, 3a, and 3c, the curvilinear projection 90 is positioned within and engages the curvilinear depression 92, preventing outward movement of the middle of the door 24 on its hinges 26. When the latching lever assembly 76 is rotated to the position depicted in FIGS. 1, 3b and 3d, the curvilinear projection 90 moves out of and disengages the curvilinear depression 92 to release the middle of the door 24. The locking levers 84 and 85 are similar to the locking lever assembly 76 as thus far described and engage and disengage curvilinear depressions 92*a* and 92*b* (FIG. 1) formed in the locking brackets 88 and 89 which are similar to the locking bracket 88. Thus, in preferred embodiments, the door 24 may be locked closed at three locations: top, middle and bottom. As should be obvious, the door 24 may be locked closed at fewer or at more than three locations.

Integrally formed with the projections 78 on a surface thereof opposite from that containing the projection 90 is a raised cam member 96. The cam member 96 serves a function described below.

Referring to FIGS. 2 and 3*a*–3*c*, pivotally mounted on a split pin 98, which may be carried by the locking bracket 94, is a triangular cam follower 100. The cam follower 100 is pivotally mounted on the pin 98 near one apex thereof. Near a second apex of the cam follower 100 there is mounted a cable connector 102 similar to the cable connector 64. Held in the cable connector 102 is the second end of the movable inner portion 65 of the control cable 66. Mounted near the third apex of the cam follower 100 is a pin 104. Held on the central portion of the pin 104 is one end of a flat, spiral spring 108. As viewed in FIGS. 2 and 3*a*–3*d*, the spiral spring 108 is wrapped around the split pin 98 between a pair of washers 110 surrounding the pin 98 and the other end of the spring 108 is located in a groove 112 formed longitudinally in the pin 104. The top washer 110 may be held in place by a cotter key 113 which passes through the pin 98. The spiral spring 108 applies a bias force to the cam follower 100 which tends to pivot the cam follower 100 in a clockwise direction on the pin 98 as viewed in FIGS. 2 and 3*a*–3*d*. A surface 114 joining two of the apices of the cam follower 100 lies on the path of movement of the cam member 96 as the locking lever assembly 76 rotates clockwise on the stub shaft 75.

Also pivotally mounted to the pin 98 and overlying the cam follower 100 is a door latch 116. The door latch 116 comprises two integral projections 118 and 120. The projection 118 has a latch hook 122 formed at the free end thereof. Between the latch hook 122 and the pin 98, the projection 118 has a surface 124 which lies on the path of movement of the pin 104 as the cam follower 100 rotates clockwise on the pin 98. The projection 120 also has a surface 125 running between its free end and the pin 98. The surface 125 lies in the path of movement of the cable connector 102 as the cam follower 100 rotates counterclockwise on the pin 98.

A first latch bracket 126 is mounted to the rear surface of the front wall 20. The first latch bracket 126 comprises a base 128 and a pair of upstanding side walls 130. As viewed in FIG. 3*d*, the left-hand side wall 130 is abutted by, and serves as a stop for, the projection 118 following clockwise pivoting the door latch 116. As viewed in FIGS. 2 and 3*a*–3*d*, the right-hand side wall 130 contains a slot or cutout 132 through which the latch hook 122 is movable. Attached to the rear surface of the door 24 is a second latch bracket 134. The second latch bracket 134 comprises a base 136 and an upstanding wall 138 having a slot or cutout 140 formed therethrough. The slot 140 is so formed that the latch hook 122 may enter and pass therethrough. When the latch hook 122 assumes the position shown in FIGS. 2 and 3*a*–3*c* and passes through the slots 132 and 140, the door 24 is latched in its closed position, regardless of the position of the locking lever assembly 76. When the latch hook 122 is withdrawn from the slot 140 (FIG. 3*d*), the door 24 is not latched.

A cable housing assembly 142 (FIGS. 3*a*–3*d*) similar to the cable housing assembly 69, is held in a bracket 144 mounted to the rear surface of the front wall 20. The assembly 142 mounts the second end of the stationary outer portion 68 of the control cable 66.

The operation of the interlock 10 according to the present invention is now described with particular reference to FIGS. 3*a*–3*d*. In FIG. 3*a*, the switches 14 are closed and the door 24 is both locked by the locking lever assembly 76 and latched by the door latch 116. Specifically, the handle 44 is positioned in the pocket 72 so that the curvilinear projection 90 on the projection 78 is within the curvilinear depression 92 in the locking bracket 94. Also, the locking levers 84 and 85 engage their respective latching brackets 88 and 89. Furthermore, the cam member 96 engages the surface 114 of the cam follower 100 so that the cable connector 102 abuts the surface 125 of the projection 120 on the door latch 116. This abutment maintains the door latch 116 in its counterclockwise position wherein the latch hook 122 passes through both slots 132 and 140 preventing relative movement between the latch brackets 126 and 134 and, therefore, movement of the door 24. Thus, the door 24 is held closed by the positions of the locking lever assembly 76, the locking levers 84 and 85, and the door latch 116.

Since the switches 14 are closed, the locking stud 62 abuts or is adjacent to the peripheral surface 52 of the cam 50. As a consequence, the locking arm 58 cannot rotate clockwise on the pin 60 and is held in the position depicted in FIG. 3*a*. Turning now to FIG. 3*c*, it will be seen that the locking lever assembly 76 and the door latch 116 have the same positions they assumed in FIG. 3*a*, but the switches 14 have been opened. Opening the switches 14 has rotated the shaft or strut 38 counterclockwise, positioning the notch 56 adjacent to the locking stud 62. Accordingly, the locking arm 58 is now capable of rotating clockwise to position the locking stud 62 within the notch 56. However, such rotation of the locking arm 58 cannot occur because the cam follower 100 continues to be maintained in the position it had in FIG. 3*a* due to the engagement of the surface 114 thereof by the cam member 96. With the cam follower 100 held in the position shown in FIGS. 3*a* and 3*c*, the second end of the movable inner portion 65 of the control cable 66 cannot move. This prevents the first end of the inner portion 65 of the cable 66 from moving, and, accordingly, the locking arm 58 cannot pivot clockwise on the pin 57. Further, the door 24 cannot yet be opened because the abutment of the cable connector 102 with the surface 125 continues to hold the door latch 116 in its counterclockwise position so that the latch hook 122 is positioned in both slots 132 and 140. Moreover, the locking lever assembly 76 and the locking levers 84 and 85 remain engaged with their respective locking brackets 88, 89 and 94.

Going now from FIGS. 3*c* to 3*d*, it will be assumed that the locking lever assembly 76 is rotated counterclockwise by appropriate manipulation of the handle 44. Manipulation of the handle 44 moves the latch rod 81 upwardly to rotate the locking lever assembly 76 and the locking levers 84 and 85 counterclockwise. Counterclockwise rotation of the locking lever assembly 76 moves the curvilinear projection 90 out of the curvilinear depression 92. Also, the locking levers 84 and 85 disengage their locking brackets 88 and 89. Thus, the door 24 is unlocked at its top, middle and bottom. Rotation of the locking lever assembly 76 moves the cam member 96 out of engagement with the surface 114 of the cam follower 100. With the cam follower 100 now free to rotate on the pin 98, such rotation is achieved by the action of the spiral spring 108. As the cam follower 100 rotates clockwise, the cable connector 102 is moved away from the surface 125 and the pin 104 is moved toward, and ultimately abuts, the surface 124 of the projection 118 on the door latch 116. Further rotation of the cam follower 100 by the spring 108 rotates the door latch 116 clockwise until the latch hook 122 moves out of the slot 140 in the wall 138 of the second latch bracket 134. Accordingly, at this point, the door 24 is unlocked and unlatched and may be opened on its hinges 26.

Clockwise rotation of the cam follower 100 by the spring 108 also moves the second end of the movable inner portion 65 of the control cable 66 downwardly. Downward movement of the second end of the movable portion 65 of the control cable 66 moves the first end thereof and the left end of the locking arm 58 upwardly, pivoting the locking arm 58 clockwise on the pin 57. Clockwise pivoting of the locking arm 58 ultimately results in the locking stud 62 entering the notch 56. With the locking stud 62 located in the notch 56, the cam 50 is unable to rotate and, accordingly, the shaft or strut 38 is unable to rotate. As a consequence, the opened switches 14 cannot be closed and are held open.

Returning to FIG. 3*a*, it will now be assumed that with the switches 14 in the closed position, the locking lever 76 is rotated counterclockwise. Going from FIG. 3*a* to FIG. 3*b*, it may be seen that clockwise rotation of the locking lever assembly 76 due to appropriate manipulation of the handle 44 results in disengagement of the cam member 96 from the surface 114 of the cam follower 100. Also eliminated, as a consequence of this rotation, is the unlocking of the door 24 due to the disengagement of the projection 90 from the depression 92 and the disengagement of the locking levers 84 and 85 from their locking brackets 88 and 89. Nevertheless, the door 24 remains latched closed in FIG. 3*b* because the switches 14 remain closed. Specifically, because the switches 14 are closed, the cam 50 assumes the position depicted in FIG. 3*b*. In this position of the cam 50, the locking stud 62 is maintained against the peripheral portion 52 of the cam 50 and the locking arm 58 cannot pivot clockwise on the pin 60. Since the locking arm 58 is held in the position shown in FIG. 3*b*, the first end of the movable portion 65 of the control cable 66 is prevented from moving upwardly. Because the first end of the movable portion 65 of the control cable 66 cannot move upwardly, the second end thereof cannot move downwardly and the cam follower 100 is unable to pivot clockwise under the influence of the spring 108. Thus, the cable connector 102 on the cam follower 100 is maintained in abutment with the surface 125 of the projection 120 on the door latch 116. This, of course, maintains the latch hook 122 within the slot 140 in the second latch bracket 134, preventing the door 24 from being opened. If, after the elements assume the positions depicted in FIG. 3*b*, the switches 14 are then opened, the conditions depicted in FIG. 3*d* again obtain. Specifically, with the switches 14 open and with the door handle 44 having been previously manipulated, the door 24 is now freed for opening movement and the switches 14 are prevented from closing.

Assuming that, following the assumption of the positions shown in FIG. 3*d*, the door 24 is opened and then reclosed, the switches 14 may not be reclosed until the door handle 44 has been appropriately manipulated. Appropriate manipulation of the handle 44 results in clockwise rotation of the locking lever assembly 76. During clockwise rotation of the locking lever assembly 76, the cam member 96 is brought into engagement with the surface 114 of the cam follower 100. Continued clockwise rotation of the locking lever assembly 76 pivots the cam follower 100 counterclockwise until the cable connector 102 abuts the surface 125 of the projection 120 on the door latch 116. Further continued clockwise rotation of the locking lever assembly 76 results in further counterclockwise pivoting of the cam follower 100 and in sufficient counterclockwise rotation of the door latch hook 122 to reenter the slot 140 in the second latch bracket 134. Accordingly, nearly simultaneously the door 24 is relatched and relocked in its closed position by entry of the latch hook 122 into the slot 140, by the entry of the projection 90 into the depression 92, and by reengagement of the locking brackets 88 and 89 by the locking lever 84 and 85. Once the locking lever assembly 76 has rotated clockwise, as shown in FIG. 3*c*, the second end of the movable portion 65 of the control cable 66 is moved sufficiently upwardly and the first end thereof is moved sufficiently downwardly to rotate the locking arm 58 counterclockwise on the pin 57. Counterclockwise rotation of the locking arm 58 moves the locking stud 62 out of the notch 56 and, accordingly, at the point of time shown in FIG. 3*c*, the switches 14 may be reclosed (as shown in FIG. 3*a*) since the cam 50 is now free to rotate.

In going from FIG. 3*d* to FIG. 3*c* to FIG. 3*a*, the cam member 96 engages the surface 114 of the cam follower 100. The initial engagement is at a point on the surface 114 which is both near the apex of the cam follower 100 mounting the cable connector 102 and remote from the pin 98. Such engagement has the effect of rapidly pivoting the cam follower 100 on the pin 98 following initial engagement. During such rapid pivoting, the cable connector 102 and the second end of the movable portion 65 of the control cable 66 are moved rapidly upwardly, even before the cable connector 102 engages the surface 125. Thus, by the time the cable connector 102 engages the surface 125, the first end of the movable portion 65 of the control cable 66 has moved sufficiently downwardly to remove or nearly remove the locking stud 62 from the notch 56. If, at the time the cable connector 102 engages the surface 125, but before the time the latch hook 122 has entered the slot 140, the switches 14 are closed, the door 24 is latched shut. Specifically, closure of the switches 14 when the locking stud 62 is nearly removed from the notch 56, rotates the cam 50 to force the stud 62 out of the notch 56 and against the surface 52 thereof. This forced removal of the stud 62 sufficiently moves the inner portion 65 of the control cable 66 so that the cam follower 100 and the door latch 116 are rotated fully counterclockwise and the latch arm 122 enters the slot 140. As can be seen in FIGS. 2 and 3*a*–3*d*, when the cable connector 102 just engages the surface 125, the locking lever assembly 76 and the locking levers 84 and 85 partially engage the locking brackets 94, 88 and 89. Accordingly, closure of the switches 14 at the inception of the locking of the door 24 positively results in the latching of the door 24 by the door latch 116. The surface of the cam 50 may be appropriately configured near the notch 56 to ensure that the stud 62 is forced out of the notch 56, as described above.

As can be seen from the above description, the interlock 10 is convenient to fabricate and assemble. The locking brackets 88, 89 and 94, the locking lever assembly 76, and the locking levers 84 and 85 may be simple case metal parts which are sufficiently robust to resist attempts at forcing the door 24 open. The cam 50, the locking arm 58, the latch rod 81, the cam follower 100, the door latch 116, and the latch brackets 126 and 134 may be simple stamped metal parts. The assembly of these parts to the strut or shaft 38, to the rear surface of the front wall 20, and to the rear surface of the door 24 is easily achieved. The need to precisely control the alignment, location and size of the parts is minimized. For example, the relation of the locking stud 62 to the notch 56 is not critical, as long as the notch 56 is sufficiently wide to be entered by the stud 62 when the cam 50 is positioned as in FIGS. 3*c* and 3*d*. Even if the width of the notch 56 is substantially greater than the diameter of the stud 62, the limited amount of rotation of the cam 50 permitted thereby can be easily rendered insufficient to permit closure of the switch 14 when the stud 62 is in the notch 56. Also, the interrelationships among the length of the latch hook 122, the positions of the cable connector 102 and the pin 104 relative to the surfaces 124 and 125, and the positioning of the latch brackets 126 and 134 are not overly critical. The cable connector 102 and the pin 104 may easily be positioned on the cam followers 100 and the latch bracket 134 may easily be located on the rear surface of the door 24 to assure that the latch hook 122 enters the slot 140 when the cam follower 100 is in its counterclockwise position and that the latch hook 122 is not within the slot 140 when the cam follower 100 is in its clockwise position. The only operation even remotely involving critical adjustment is the attachment of the ends of the inner portion 65 of the control cable 66 to the cable connector 64 and 102. This attachment is easily made so that the rotative positions of the locking arm 58 and the cam follower 100 are properly related to achieve the above-described operation of the interlock 100.

Except for the locking lever 58, the various parts of the interlock 10 are not subjected to potentially high forces. The locking lever 58 and its pin 57 and locking stud 62 may experience high forces in the event that an attempt is made to close the switches 14 while the door 24 is opened. These parts can be easily fabricated to withstand such forces. The parts of the door control portion 67 of the interlock do not experience any high forces. The spring 108 need be only sufficiently robust to rotate the cam follower 100 and the door latch 116, move the inner portion 65 of the control cable 66, and rotate the locking arm 58 in the event the door 24 is unlocked and the switches 14 are opened. Once the locking stud 62 is in the notch 56, the door control portion 62, including the spring 108, do not experience any forces which may be applied to the locking arm 58 by the cam 50 and need only hold the stud 62 in the notch. In the event the door 24 is unlocked, but the switches 14 are closed, the stud 62, the arm 58 and the control cable 66 need be only sufficiently robust to resist the force of the spring 108. The moving force for the door latch 116 is derived only from the spring 108; the control cable 66 need transmit no great amount of force from the switch control portion 45 for moving the door latch 116.

What is claimed is:

1. An improved interlock for electrical apparatus located in a walled enclosure, the interlock being of the type which prevents opening a door of the enclosure if the apparatus is in a first condition and permits opening the door to provide access to the apparatus only if the apparatus is in a second condition, the interlock preventing the apparatus from assuming the first condition when the door is open, wherein the improvement comprises:

latching means movable between a first position, for latching the closed door against opening, and a second position, for unlatching the closed door for opening;

cam follower means movable between a first position, for holding the latching means in its first position, and a second position, for holding the latching means in its second position;

means for biasing the cam follower toward its second position;

locking means operable from the exterior of the enclosure and movable between a first position, for locking the closed door against opening and for holding the cam follower means in its first position, and a second position, for unlocking the closed door for opening and for freeing the cam follower means for movement to its second position by the biasing means, the closed door being openable only if the locking means and the latching means are both in their second positions;

control means movable between a first and a second position, the control means being unable to move out of its first position if the apparatus is not in its second condition and being movable to its second position only if the apparatus is in its second condition;

means for preventing the apparatus from assuming its first condition if the control means is in its second position; and means interconnecting the control means and the cam follower means for (a) holding the control means in its first position when the cam follower means is held in its first position, (b) moving the control means to its second position when the cam follower means moves to its second position and the apparatus is in its second condition, and (c) preventing the cam follower means from moving to its second position if the control means is unable to move to its second position.

2. An interlock as in claim 1, wherein the cam follower means is on the enclosure, the locking means and the latching means are partly on the door and partly on the enclosure, and the control means is associated with the apparatus.

3. An interlock as in claim 2, wherein the latching means comprises a latching bracket on the rear surface of the door, a pin on the interior of the enclosure, and a latching lever pivoted on the pin, one end of the latching lever engaging the latching bracket in the first position of the latching means and disengaging the latching bracket in the second position of the latching means;

the cam follower means comprises a plate pivotally mounted on the pin, a first member on the plate for engaging the latching lever near its other end when the cam follower mean is in its first position to effect engagement of the latching bracket by the one end of the latching lever, and a second member on the plate for engaging the latching lever near its one end when the cam follower means is in its second position to effect disengagement of the one end of the latching lever from the latching bracket;

the biasing means comprises a spring connected between the second member and the pin to bias the plate for pivoting which brings the second member into engagement with the latching lever near the one end thereof;

the locking means comprises a locking bracket on the enclosure, a locking lever rotatably mounted on the rear surface of the door, a cam member on the latching lever which engages the plate in the first position of the locking means to effect engagement of the latching lever by the first member, movement of the locking means to its second position disengaging the cam member from the plate so that the spring may move the plate to its second position if the control means is movable to its second position, and a handle on and manipulable from the front surface of the door to rotate the locking lever into and out of engagement with the locking bracket when the door is closed and to move the cam member into and out of engagement with the plate;

the control means and the preventing means comprise a cam with a notch in a cam surface thereof, the cam moving as the condition of the apparatus changes to position the notch at a first position, when the apparatus assumes its first condition, or a second position, when the apparatus assumes its second condition, a pivotally mounted arm having a stud thereon, the arm being freely movable between a first and a second position corresponding to the first and second position of the control means only when the notch is in its second position whereat it is enterable by the stud, the arm being unable to move out of its first position when the notch is not in its second position due to interference between the cam surface and the stud, entry of the stud into the notch preventing the notch from moving out of its second position and preventing the apparatus from assuming the first condition; and the interconnecting means comprises a control cable attached between the arm and the first member on the plate so that the arm and the plate assume complementary positions.

4. An improved interlock for electrical apparatus located in a walled enclosure, the interlock being of the type which prevents opening a door of the enclosure if the apparatus is in a first condition and permits opening the door to provide access to the apparatus only if the apparatus is in a second condition, the interlock preventing the apparatus from assuming the first condition when the door is open, wherein the improvement comprises:

locking means on the door and operable from the exterior of the enclosure for movement between a first position, whereat the closed door is locked against opeing, and a second position, whereat the door is unlocked for opening;

latching means on the enclosure for movement between a first position, whereat the closed door is latched against opening, and a second position, whereat the door is unlatched for opening, the closed door being openable only if the locking means and the latching means are both in their second positions;

cam follower means on the enclosure for movement between a first position, whereat the latching means is held in the first position, and a second position, whereat the latching means is held in its second position;

means for biasing the cam follower toward the second position;

cam means on the locking means for holding the cam follower means in its first position when the locking means is in its first position and for freeing the cam follower means for movement to its second position by the biasing means when the locking means is in its second position;

movable control means on the apparatus for movement between a first and a second position, the control means being unable to move out of its first position if the apparatus is not in its second condition and being movable to its second position only if the apparatus is in its second condition;

means for preventing the apparatus from assuming its first condition if the control means is in its second position; and means interconnecting the control means and the cam follower means for (a) holding the control means in its first position when the cam follower means is held in its first position, (b) moving the control means to its second position when the cam follower means moves to its second position and the apparatus is in its second condition, and (c) preventing the cam follower means from moving to its second position if the control means is unable to move to its second position.

5. An interlock as in claim 1 or 4, wherein with the door closed, as the locking means moves from its second position toward its first position, and before the latching means is moved out of its second position by the cam follower means as the cam follower means is moved from its second position toward its first position by the locking means, the interconnecting means affects sufficient movement of the control means from its second toward its first position so that assumption of the first condition by the apparatus moves the control means fully to its first position and the interconnecting means moves the cam follower means fully to its first position, thereby moving the latching means fully to its first position.

6. An interlock as in claim 1 or 4, wherein the apparatus includes a high voltage switch which is closed in the first condition of the apparatus and is open in the second condition of the apparatus.

7. An interlock as in claim 1 or 4, wherein the door is relatively movable with respect to an opening formed through a wall of the enclosure, and wherein the locking means includes a locking bracket on the rear surface of the wall, a locking lever rotatably mounted on the rear surface of the door, and a handle manipulable from the front surface of the door to rotate the locking lever into and out of engagement with the locking bracket when the door is closed.

8. An interlock as in claim 7, wherein the locking means includes a plurality of locking brackets and locking levers for locking the door at a plurality of locations, manipulation of the handle rotating the locking levers in common.

9. An interlock as in claim 1 or 4, wherein the door is relatively movable with respect to an opening formed in a wall of the enclosure, and wherein the latching means includes a latch lever rotatably mounted on the rear surface of the wall, a latch hook on the latch lever, a first latch bracket mounted to the rear surface of the wall, having a pair of upstanding side walls between which a portion of the latch lever rotates, one side wall being abutted by the latch lever in the second position of the latching means, the other side wall having a slot therethrough for guiding the latch hook and through which the latch hook protrudes in the first position of the latching means, and a second latch bracket mounted to the rear surface of the door and having a slot therethrough entered by the protruding latch hook in the first position of the latching means to prevent relative movement between the latch brackets and thereby latch the closed door against opening.

10. An interlock as in claim 1 or 4, wherein the latching means includes a latching bracket on the rear surface of the door, and a latching lever pivoted on the interior of the enclosure, one end of the latching lever engaging the latching bracket in the first position of the latching means and disengaging the latching bracket in the second position of the latching means; and the cam follower means includes a plate pivotally mounted on the interior of the enclosure, a first member on the plate for engaging the latching lever near its other end when the cam follower means is in its first position to effect engagement of the latching bracket by the one end of the latching lever, a second member on the plate for engaging the latching lever near its one end when the cam follower means is in its second position to effect disengagement of the one end of the latching lever from the latching bracket.

11. An interlock as in claim 10, which further comprises a pin attached to the enclosure for commonly pivotally mounting the latching lever and the plate, the biasing means comprising a spiral spring connected between the second member and the pin to bias the plate for pivoting movement which brings the second member into engagement with the latching lever near the one end thereof.

12. An interlock as in claim 11, wherein the interconnecting means includes a control cable within the enclosure and having a movable portion thereof attached at one end of the plate and at the other end to the control means.

13. An interlock as in claim 11, wherein the locking means includes a cam member which engages the plate in the first position of the locking means to effect engagement of the latching lever by the first member, movement of the locking means to its second position disengaging the cam member from the plate so that the biasing means may move the plate to its second position if the control means is movable to its second position.

14. An interlock as in claim 1 or 4, wherein the control means includes a member movable between a first and second position in accordance with the condition of the apparatus, and a locking lever movable between a first position, whereat the member is freely movable as the condition of the apparatus changes, and a second position, whereat the member is prevented from moving and the condition of the apparatus is, accordingly, prevented from changing, the locking lever being unable to move to its second position unless the member is in its second position indicative of the apparatus being in the second condition.

* * * * *